US006223656B1

(12) United States Patent
Glenn

(10) Patent No.: US 6,223,656 B1
(45) Date of Patent: May 1, 2001

(54) PRESSURE ENHANCED PENETRATION WITH SHAPED CHARGE PERFORATORS

(75) Inventor: Lewis A. Glenn, Danville, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 09/298,109

(22) Filed: Apr. 22, 1999

Related U.S. Application Data

(60) Provisional application No. 60/085,635, filed on May 15, 1998.

(51) Int. Cl.[7] ..... F42B 1/02

(52) U.S. Cl. ..... 102/306; 102/307; 102/313; 102/476

(58) Field of Search ..... 102/306, 307, 102/312, 313, 476

(56) References Cited

U.S. PATENT DOCUMENTS

| | | | | |
|---|---|---|---|---|
| 2,759,418 | * | 8/1956 | Ross et al. | 102/313 |
| 2,797,892 | * | 7/1957 | Ryan | 102/307 |
| 3,997,021 | | 12/1976 | Chelminski | 181/106 |
| 4,126,092 | * | 11/1978 | Cross | 102/307 |
| 4,151,798 | * | 5/1979 | Ridgeway | 102/307 |
| 4,160,412 | * | 7/1979 | Snyer et al. | 102/307 |
| 4,498,391 | * | 2/1985 | Gerco et al. | 102/313 X |
| 4,554,872 | | 11/1985 | Schleicher | 102/490 |
| 5,355,802 | | 10/1994 | Petitjean | 102/313 |
| 6,148,730 | * | 11/2000 | Watson | 102/312 X |

FOREIGN PATENT DOCUMENTS

| | | | | |
|---|---|---|---|---|
| 2672983 | * | 8/1992 | (FR) | 102/307 |
| 2005983 | * | 1/1994 | (SU) | 102/476 |

* cited by examiner

*Primary Examiner*—Peter A. Nelson
(74) *Attorney, Agent, or Firm*—Alan H. Thompson

(57) ABSTRACT

A downhole tool, adapted to retain a shaped charge surrounded by a superatmospherically pressurized light gas, is employed in a method for perforating a casing and penetrating reservoir rock around a wellbore. Penetration of a shaped charge jet can be enhanced by at least 40% by imploding a liner in the high pressure, light gas atmosphere. The gas pressure helps confine the jet on the axis of penetration in the latter stages of formation. The light gas, such as helium or hydrogen, is employed to keep the gas density low enough so as not to inhibit liner collapse.

7 Claims, 8 Drawing Sheets

PRESSURE ENHANCED PENETRATION WITH SHAPED CHARGE PERFORATORS

RELATED APPLICATIONS

This application claims the benefit of U.S. Provisional Application No. 60/085,635, filed May 15, 1998.

The United States Government has rights in this invention pursuant to Contract No. W-7405-ENG-48 between the United States Department of Energy and the University of California for the operation of Lawrence Livermore National Laboratory.

BACKGROUND OF THE INVENTION

1. Field of the Invention

The present invention relates to the production of hydrocarbons from a borehole. More particularly, the invention relates to a method and apparatus for perforating and fracturing a formation surrounding a borehole.

2. Description of Related Art

Techniques for perforating and fracturing a formation surrounding a borehole are known in the art. The most common technique for perforating and fracturing a formation to stimulate production includes the steps of: 1) penetrating a production zone with a projectile, such as a shaped charge; and 2) hydraulically pressurizing the borehole to expand or propagate the fractures initiated by the shaped charge.

Modern shaped charges are widely used for both military and commercial applications. Although the main operation is remarkably similar in both applications, there are at least two significant differences in the devices actually employed. One difference is cost. Military applications generally demand much higher performance and, in particular, high reproducibility. This, in turn, requires the liner portion of the shaped charge to be forged and precision machined.

In the commercial use of the shaped charge in oil or gas well stimulation, the jet from the shaped charge is employed to create a flow path from the reservoir to the wellbore. In this application, a large number of perforators is inserted into the wellbore in what is called a gun. Although there are three basic types of guns, perhaps the most common is the casing gun, which can be run into the well on a wireline or conveyed by tubing. The charges are contained in a steel tube, protected from impact and from the well fluids, and are arranged so that they face radially outward from the vertical axis of the carrier. In these devices, the liners are pressed using powder metal technology and are relatively less expensive than those used in typical military uses, e.g., missile warheads.

Another factor that distinguishes commercial shaped charges from those used in weapons is standoff, i.e., the distance from the liner base to the target (usually measured in charge diameters). The penetrating effectiveness of a shaped charge jet is markedly enhanced by standoff. The reason is that shaped charge jets normally are formed with a high axial velocity gradient, the tip moving at speeds of 6–10 km/s. The standoff distance allows the jet to stretch or elongate before encountering the target and, to first order, the depth of penetration is directly proportional to the length of the penetrator. There is an optimum standoff. If the distance to the target is too great, the penetration can be much less than if there were no standoff. This occurs because the jet can only stretch a given amount before breaking; once broken the particles are easily deflected by small perturbations and no longer produce a coherent, unidirectional penetrator. With optimal standoff, typically 6–8 charge diameters (CD), the penetration can be enhanced by 50% or more, relative to that achieved with zero standoff. Commercial perforators, however, are rarely able to operate at more than 1 CD because they must fit inside the casing gun which, in turn, must fit inside the casing.

Techniques to increase the efficiency of hydrocarbon production in the borehole utilizing guns and pressurizing sections of the borehole have been described in the recent past. For example, Petitjean, U.S. Pat. No. 5,355,802, describes a method and apparatus for firing a shaped charge through a gas zone of propellant combustion gases. A propellant is ignited downhole, releasing gas into the borehole to pressurize a portion of the borehole. The firing of the shaped charges is delayed until the pressure level is significantly above the breakdown pressure of the formation, but still below that of the casing. Although such a technique can improve the penetration effects of shaped charge perforators, a need still exists to continually improve penetration of a reservoir surrounding a borehole.

SUMMARY OF THE INVENTION

The present invention provides a method and apparatus for perforating and fracturing a formation surrounding a borehole and propagating that fracture to increase the efficiency of hydrocarbon production in the borehole. The invention is advantageous because it benefits from the energy of shaped charges to perforate and initiate fractures in the formation. In addition, it provides better propagation of the fractures. The greater efficiency is achieved by pressurizing an interior section of a sealable container of a downhole tool, such as a casing gun, using a light gas, i.e., a gaseous substance which has a density less than air at the same conditions of temperature and pressure. The light gas is usually supplied (pressurized) and sealed at the earth's surface; although gas-generating materials which release the light gas within the gun prior to the firing of the shaped charges can also be employed. The travel of the shaped charge jet in the light gas atmosphere results in a longer, more narrow and stable jet—thus greater penetration.

According to one aspect of the invention, a casing gun, containing shaped charges surrounded by the pressurized light gas within the gun, is positioned in a production zone of a borehole. The shaped charges are fired and their liners collapsed within the light gas atmosphere. The resulting shaped charge jet perforates the casing gunwall, penetrating through the wellbore fluids, through the well casing wall, into the reservoir rock and concomitantly the escaping light gas from within the gun increases the pressure level in the production zone. The pressure level in the production zone can be increased to significantly above the breakdown pressure of the formation. To maximize the efficiency of the technique in a cased hole, the pressure level within the gun can approach the maximum that can be applied to the wall of the gun and/or well casing; however, penetration of a shaped charge jet has been shown by experiment to be enhanced by at least 40% (vs. air) by imploding a liner in the light gas atmosphere at pressures in the range from about 1,500 psia to about 5,000 psia.

The fired shaped charges, creating the perforation tunnel through the wall of the casing gun and well casing, help to initiate fractures at particular locations in the borehole. Thus, the shaped charges are designed to accomplish a dual purpose. First, the shaped charges perforate the well casing. Second, after passing through the well casing they continue their penetration into the formation sometimes initiating a fracture. Such penetrations travel deeper than the procedures of previously known techniques. Increased efficiency is achieved at the initial penetration by increasing the jet length by squeezing on its periphery, which also produces a highly stabilized shaped charge jet. This is enabled by the firing of the shaped charges through the pressurized gas zone of substantially lower density within the gun instead of the higher density of conventional surrounding gases, such as air. The less dense, light gas zone permits effective collapse of the liner of the shaped charge.

The invention provides superior results to those obtained by the prior art because unlike the prior art, the pressure within the tool can be maximized at the time the shaped charges are fired, thus providing increased jet length and stability, and the shaped charge liners and jet can function within a light gas atmosphere to improve jet penetration. Unlike techniques that release gas from a casing gun into the well casing outside the casing gun (via gas propellant materials) as described by Petitjean, the present invention allows the shaped charge liner to collapse against a less dense gas, thus initiating the formation of the shaped charge jet within the casing gun to create greater jet length for extended penetration. Upon firing of the shaped charges, the method of the invention provides increased perforation of the well casing and initiation of the fracture in a single step.

DETAILED DESCRIPTION OF THE INVENTION

The method of the invention is useful for enhancing the penetration of a shaped charge perforator into a reservoir material by imploding a liner of a shaped charge perforator in a high pressure, light gas atmosphere toward the reservoir material. High pressures are normally a superatmospheric pressure greater than about 14.5 psia. The invention includes a gun apparatus adapted for positioning within a borehole in a subterranean earth formation. The apparatus includes means for containing the shaped charge within a chamber of a container such as a casing gun; means for surrounding the shaped charge with the pressurized light gas contained within the chamber; and means for firing the shaped charge through at least a portion of a wall of the chamber toward the exterior of the chamber, through a well casing and eventually into the reservoir material.

The container is sealable. A light gas can be introduced within the container to any predetermined pressure provided the gas is positioned to surround a liner of the shaped charge within the area in which the liner collapses during detonation and within the trajectory path of the shaped charge jet toward its target. The shaped charges are thus fired precisely at an optimum predetermined pressure level causing them to penetrate deeper into the formation than they would otherwise. The pressure provided by the light gas increases after the shaped charges have been fired. When fractures are formed, this pressure propagates the fractures further into the formation surrounding the borehole than the prior art techniques.

A feature of the invention is associated with firing the shaped charges through the pressurized, light gas zone within the sealed container. Gas is supplied prior to firing of the shaped charges from any source, creating a light gas zone within the tool that surrounds the shaped charge perforator. The light gas provides much less mass than conventional pressurized gas as heavy as air, heavier than air, a liquid or a solid, which permits the shaped charges to penetrate deeper, helping to boost the efficiency of the fracturing and propagation technique. As a result, production from the well is increased.

Figure 1:
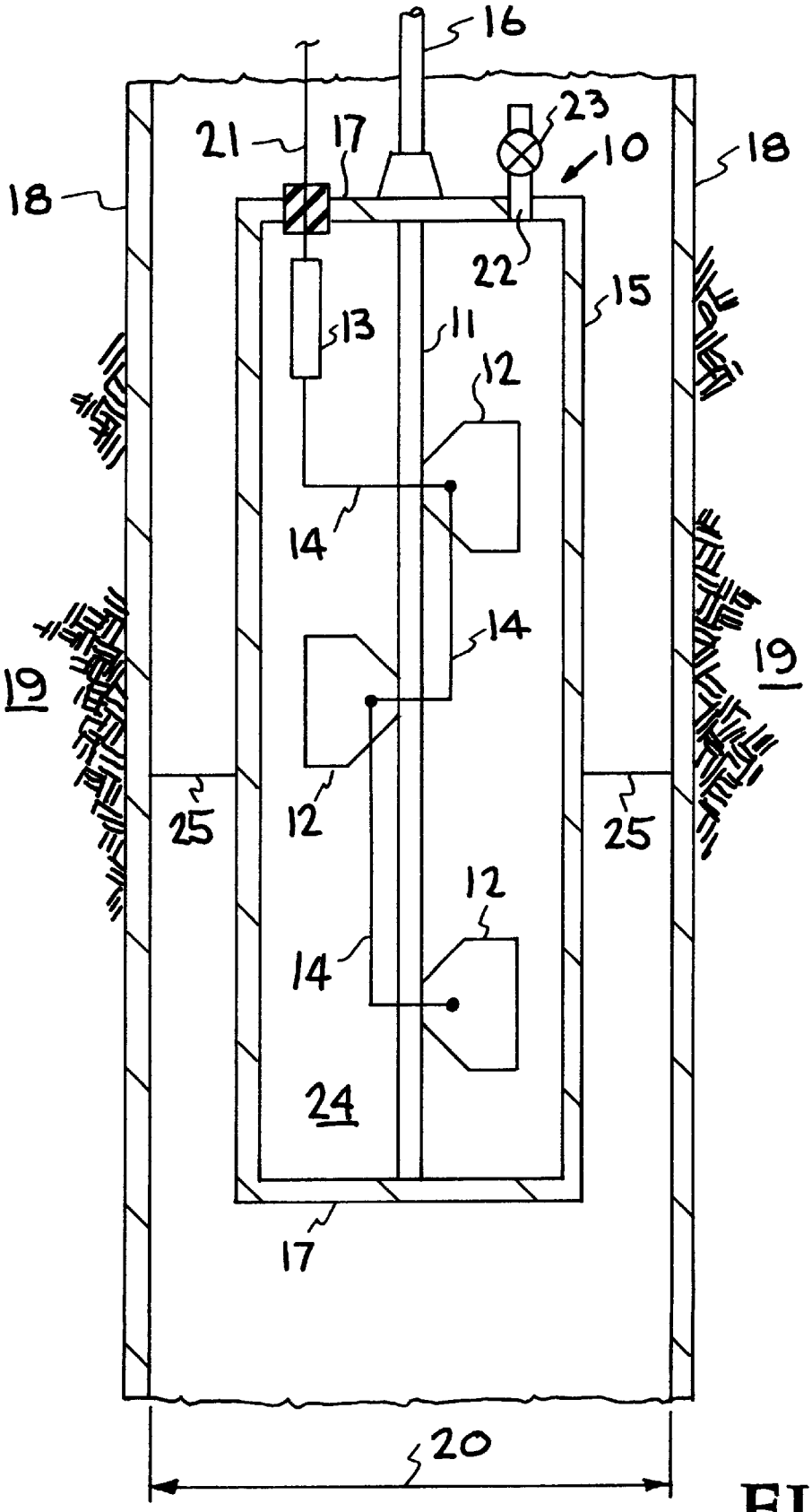
FIG. 1 shows the physical features and layout of a tool in accordance with the present invention.

FIG. 1 is a diagram illustrating the various components of a tool for perforating a well casing and propagating a fracture in a formation outside the well casing. A tool 10 includes a sealable light gas loading system and a perforation charge assembly. The perforation charge assembly is responsible for firing shaped charges 12 which are mounted on a shaped charge holder and stabilizer bar 11 that is itself mounted to end caps 17 of an elongated tubular wall 15 of tool 10. Typically elongated tubular wall 15 can be any length and is usually from about 1 to about 50 feet in length. The width or diameter of tube end caps 17 can be any dimension fitting the tool within a well casing 18 which separates a borehole 20 from a reservoir 19. Fluid 25 may optionally occupy the space between tool 10 and well casing 18. The assembly includes a detonator device 13 connected to at least one oriented shaped charge 12 via a firing cord 14. Detonator device 13 is activated by a wire (not shown), to deliver an ignition signal on firing cord 14. As is customary in wireline tools, a cable 16 connects tool 10 to a surface apparatus including a sheave and winch (not shown) at the top of the borehole for delivering signals to and from tool 10 and for suspending tool 10 in the borehole at a particular depth. Detonator 13 is connected to wireline cable 16 via wire 21. Essentially no fast burning fuse material need be employed along any of the wiring to cause detonation (firing) of the shaped charges.

The light gas loading system is responsible for pressurizing the volume within the tool. Although any means of sealing a light gas within cavity 24 of tool 10 can be employed either by surface apparatus or downhole pressurizing equipment, normally cavity 24 is filled and pressurized with the light gas at the surface through an orifice, such as opening 22, and sealed by any of several means, such as plug 23. Since the thickness of elongated tubular wall 15 can be controlled to withstand any elevated pressure due to the light gas exerted from the interior or by wellbore fluids outside the tool, the invention allows the skilled artisan to utilize relatively light materials for tool walls and caps.

The operation of the invention can be described with reference to FIG. 1. Initially, and usually at the surface, helium or other mixtures of gases having densities less than air, are introduced into cavity 24 of tool 10 via opening 22 to achieve a desired pressure and then sealed with valve 23. The tool is lowered into well casing 18 to a depth at the level of the targeted production zone of reservoir 19. The role of wire 21 is to transmit a pulse to detonator 13 upon receiving an appropriate signal from the operator of wireline cable 16. The pulse provides ignition of firing cord 14, which in turn starts the firing of the shaped charges 12 within cavity 24 containing the pressurized light gas. The precise timing of the firing of shaped charges 12 is coordinated to retain light gas in the gas volume adjacent to the collapsing area between the liners. A jet created by the fired shaped charges penetrates through elongated tube wall 15 creating an opening through which the light gas can also escape. The jet further travels through well casing 18 and into reservoir 19. In addition, a head of fluid 25 above the tool position is unnecessary to achieve maximum penetration of the shaped charge jets through well casing 18 and into reservoir 19.

In one embodiment of the invention, the weight (and hence the cost) of a casing gun can be reduced if the pressure inside and outside of the gun wall is equalized. The penetration of a shaped charge perforator into a target (e.g., concrete, reservoir rock, and the like) is little affected when the (air) pressure surrounding the perforator is increased from 0.1 to 10 MPa (14.5 to 1,450 psia). Since the gun must operate at the bottom of a well where the hydrostatic pressure can be tens of MPa, the gun wall thickness must be sufficient to withstand such hydrostatic pressures without imploding. Equalizing the pressure allows the wall thickness of the gun to be reduced substantially, and at least by a factor of 0.5, as compared to conventional gunwall thicknesses. During operation of the gun, well fluids can not be allowed inside the gun because the high density of such fluids inhibits collapse of the liners of the shaped charges.

In an exemplary embodiment, the results of a computational study of the effect of ambient pressure on shaped charge performance is described. Any conventional shaped charge can be employed in the invention. In the exemplary embodiment is used a single (commercial) perforator, i.e., an OMNI conical shaped charge (CSC) perforator, obtained from Halliburton Energy Services, Inc.

The (composite) liner is a mixture of primarily metal powders. The calculated jet tip velocity is compared with experimental data and the calculated penetration is compared with measurements made in a well-characterized (6061-T6 aluminum alloy) target.

Figure 2:
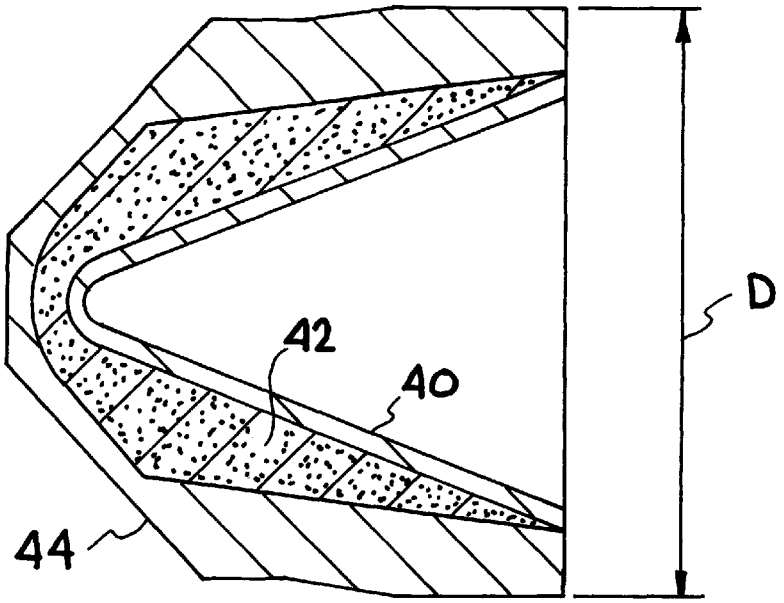
FIG. 2 illustrates a cross section of a shaped charge liner.

FIG. 2 illustrates a profile cutaway of the OMNI conical shaped charge (CSC) perforator. As indicated in FIG. 2, the outer base diameter D of the steel tamper 44 is approximately 46 mm. The explosive charge 42 weighs approximately 22.7 g and consists of about 98.5–99% RDX, with the remainder a wax filler. The liner 40 consists of a mixture of tungsten (45.20%, by weight), tin (11.05%), copper (43.19%), and graphite (0.53%) powders, together with a small (0.03%) amount of lubricating oil. The calculated density of the fully compacted liner is approximately 11.19 g/cm$^3$. Measurement of the actual density, using the method of Archimedes, yields a value of approximately 10.15 g/cm$^3$ [M. G. Vigil, *Conical Shaped Charge Pressed Powder, Metal Liner Jet Characterization and Penetration in Aluminum,* Sandia Report, SAND97-1173, May 1997.] so that an initial gas porosity of 0.0929 can be inferred. (A Grüneisen equation of state for the fully compacted powder is derived applying the resultant parameters: $c_0$=3.79 km/s, s=1.592, $g_0$=1.8, and b=0.5. Here, $c_0$ is the bulk sound speed, s is the slope of the shock Hugoniot (in shock velocity-particle velocity space), $g_0$ is the initial Grütneisen parameter, and b is the first order volume correction to $g_0$.).

All simulations are performed with the CALE hydrocode, developed at LLNL by R. Tipton [See LLNL Laboratory Report 961101, November 1996]. The pore compaction treatment in this code follows closely the standard p-alpha formulation initially devised by Carroll and Holt [See M. M. Carroll and A. C. Holt, *J. Appl. Phys.,* 43, 759–761 (1972)]. A Hugoniot elastic limit of 50 MPa is prescribed, with complete pore crushup occurring at 161 MPa. No independent measurements are made of the liner strength so that, in effect, the strength model constituted a degree of freedom available to help fit the penetration data. The standard Steinberg-Guinan ductile failure model available in CALE, employed with parameters derived for copper, results in excellent agreement between predicted and measured jet tip velocity and in depth of penetration in (6061-T6) aluminum alloy targets (the experiments are described by M. G. Vigil above).

Figure 3A:
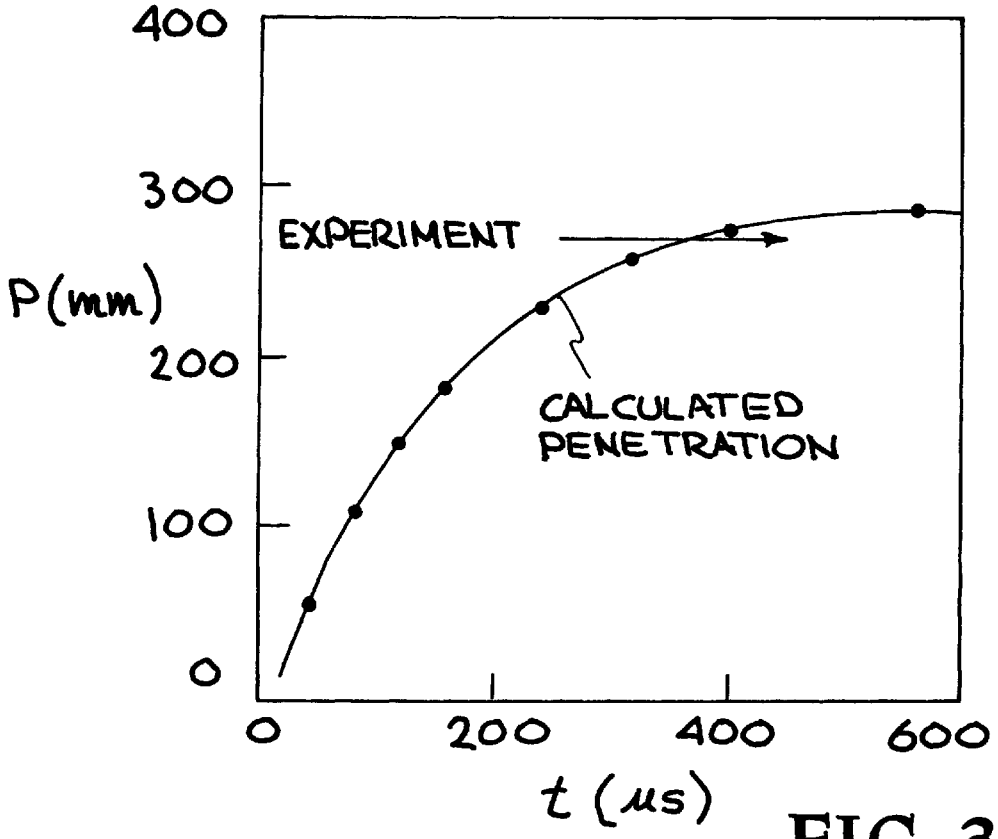
FIG. 3*a* shows calculations of jet formation and penetration in an aluminum alloy target and FIG. 3*b* shows a snapshot of such calculation at 10 microsecs.
Figure 3B:
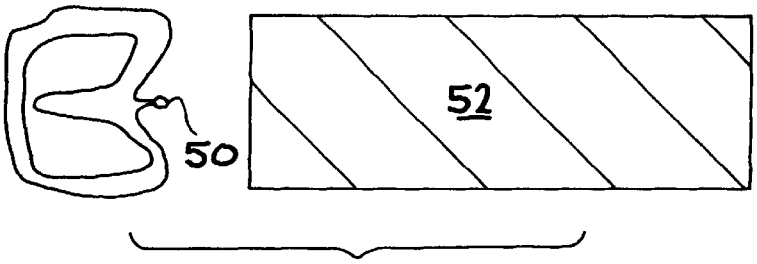

FIG. 3*a* shows the calculated penetration as a function of time, together with FIG. 3*b*, a snapshot crossection of such penetration into 6061-T6 aluminum target 52 at approximately 10 microseconds. The velocity of the calculated jet tip 50 at this time is approximately 6.4 km/s, the same value measured from the radiographs in the experiment. The final penetration is approximately 265 mm, again in excellent agreement with the interpolated curve derived from the measurements (the calculation is performed at a standoff of approximately 22.1 mm; the experiments are performed at standoffs of approximately 6.35, 152.4, and 482.6 mm). The standoff position chosen for the calculations is the same as the position of the first target plate employed in the concrete penetration examples described hereinafter.

Although concrete is not a perfect surrogate for reservoir rock, it provides a suitable comparison for predicted penetration of jets from shaped charges for utilizing data from experiments in which the ambient pressure is atmospheric or otherwise. Several calculations of the penetration of shaped charges into standard (API RP43) concrete targets can be performed when the pressure surrounding the perforator is varied.

Figure 4:
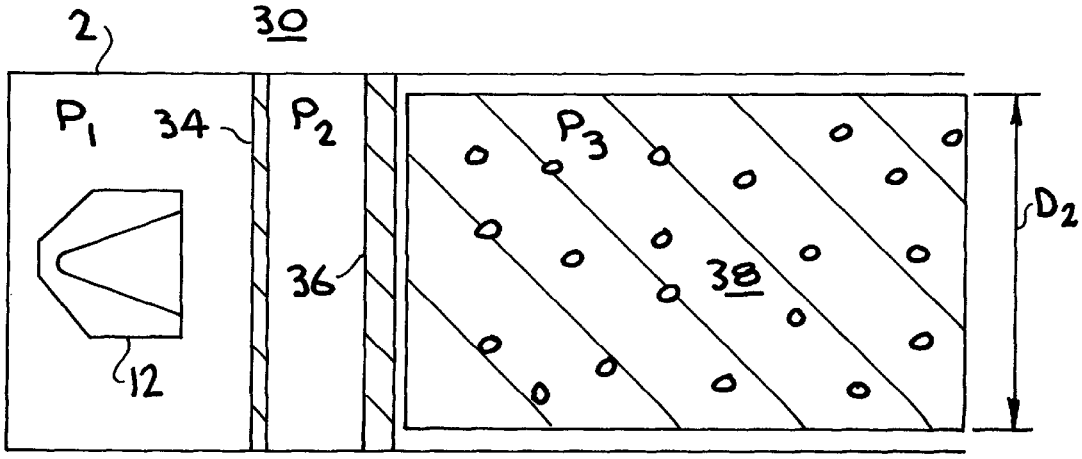
FIG. 4 illustrates a cross section of a simulated wellbore setup for concrete penetration.

FIG. 4 illustrates the downhole setup 30 (simulating area about a wellhead such as that described by shaped charge 12, elongated tubular wall 15, well casing wall 18 and reservoir rock 19 of FIG. 1) from which concrete penetration is measured so as to essentially replicate the API Section 1 target. The outer boundary 32 of the setup is rigid. The first steel target plate 34 represents a gun wall and the second steel target plate 36 adjacent the concrete 38 represents a well casing. $P_1$ is the ambient pressure surrounding the perforator (i.e., the pressure within the gunwall), $P_2$ is the pressure in the wellbore (i.e., the wellbore pressure which is located outside the gunwall and inside the well casing wall), and $P_3$ represents the reservoir pressure having a 4 inch diameter D2.

The concrete model employed is consistent with the specification for API RP43 Section 1 targets and fits the shock Hugoniot data reported for this material by Furnish

[M. Furnish, Shock Properties of the API-43 Concrete and Castlegate Sandstone (ACTI Near Wellbore Mechanics Project), Sandia National Laboratory Draft Technical Memorandum, 1997.]. The initial gas porosity is approximately 0.18, corresponding to a density of approximately 2.15 g/cm$^3$. The unconfined compressive strength is approximately 51.7 MPa (7,260 psi), and the strength is increased with pressure up to a maximum of 160 MPa at a pressure of 1 GPa.

Figure 5:
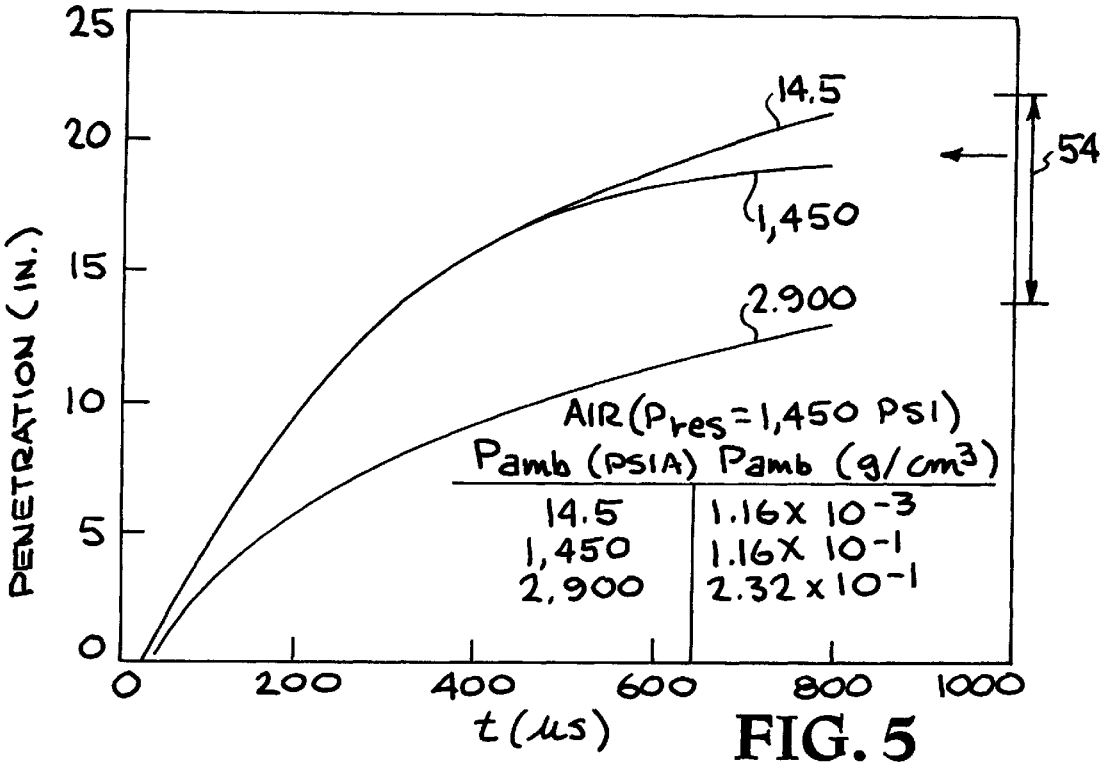
FIG. 5 shows the calculated penetration of shaped charges into a concrete target.

Penetration calculations with air as the surrounding gas are initially performed. FIG. 5 shows the results when the pressure $P_1$ (air) is varied in a production zone 54 from 0.1 to 20 MPa (i.e., 14.5 to 2,900 psia). The reservoir and wellbore pressures (i.e., $P_2$ and $P_3$, respectively) are assumed equal and set to 1,450 psia (for consistency with industry practice, English units are used). It is observed that the penetration decreases monotonically with increasing ambient pressure (simulated interior gun pressure surrounding the perforator), but that the final penetration is only about 8% less as $P_1$ increases from 0.01 to 10 MPa. The calculation with $P_1$ set to 14.5 psia is in reasonably good agreement with experimental data. As shown in FIG. 5, the average measured penetration in the present setup is 19.7 inches when the manufacturing process is under control. The measured range of penetration in production zone 54 is from 14 to 22 inches during a production run. As the simulated interior gun pressure containing air exceeds 1,450 psia, the penetration is seen to rapidly diminish.

Figure 6A:
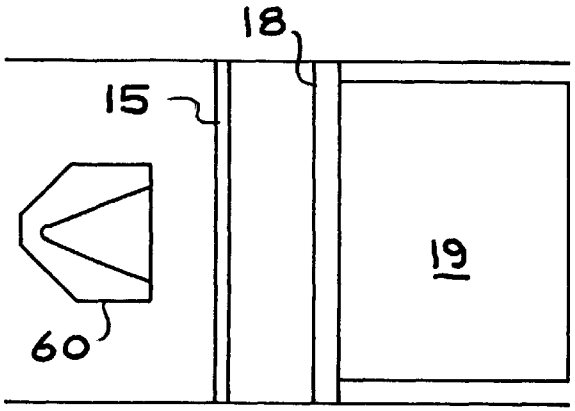
FIGS. 6*a*, 6*b*, 6*c* and 6*d* illustrate a shaped charge liner collapse when ambient air is 4350 psia.
Figure 6B:
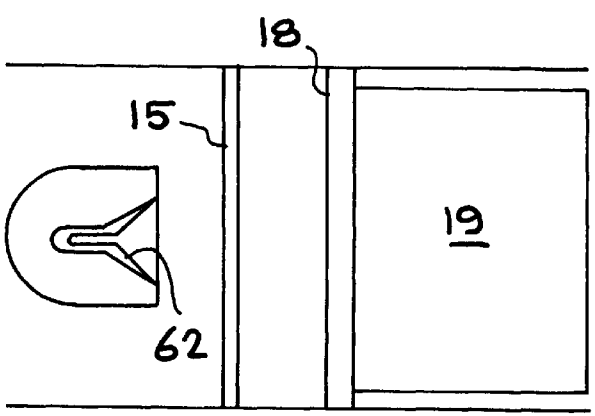
Figure 6C:
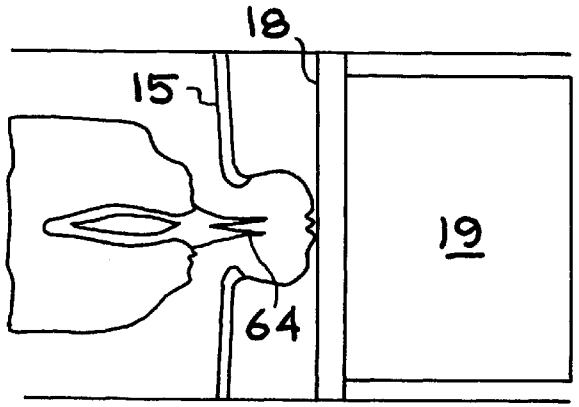
Figure 6D:
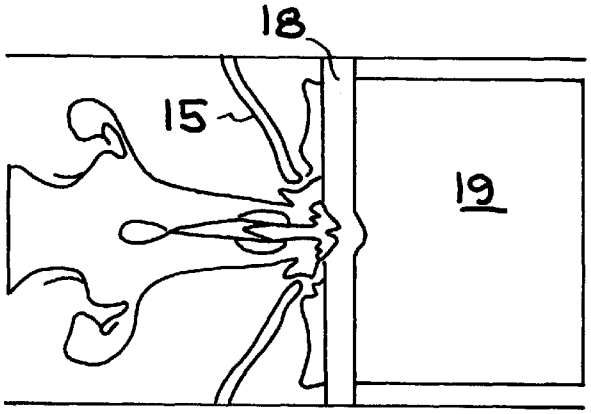

FIGS. 6*a*, 6*b*, 6*c* and 6*d* illustrate stages of shaped charge liner collapse when $P_1$ (air) is increased from 2,900 to 4,350 psia. FIG. 6*a* shows the intact, original liner prior to detonation, i.e., at t=0, and peretration through toolwall 15, well casing 18 and into reservior rock 19. As illustrated in FIG. 6*b* at 10 microseconds, when the jet at low ambient air pressure is already well developed, no jet is observed; the liner collapse has been inhibited by the formation of a high-pressure air bubble. At 40 microseconds (illustrated in FIG. 6*c*), when the penetration in the concrete at low ambient air pressure is over 5 in., an annular jet has formed, and only the first steel plate has been perforated. As illustrated in FIG. 6*d* at 200 microseconds, the jet has completely broken up and even the steel casing has not been completely perforated.

It is evident that the pressure exerted on the jet is beneficial since the jet is confined on the axis during the latter phase of formation. However, as increasing pressures are exerted within the gun, the increasing mass of the air inside the conical liner becomes increasingly difficult to expel during detonation as the density of such gases is increased. Eventually, the density effect inhibits the formation of a stable jet altogether, as seen in FIG. 6*d*.

In the method of the invention a light gas, i.e., lighter than air, such as hydrogen or helium, is employed to surround the shaped charge inside the gun. At the same pressure and temperature, the density of the light gas within the gun is less by a factor of more than about 14 with the former and more than about 7 with the latter. The practical advantage of using an inert gas outweighs the theoretical advantage of utilizing a reactive gas such as hydrogen.

Figure 7:
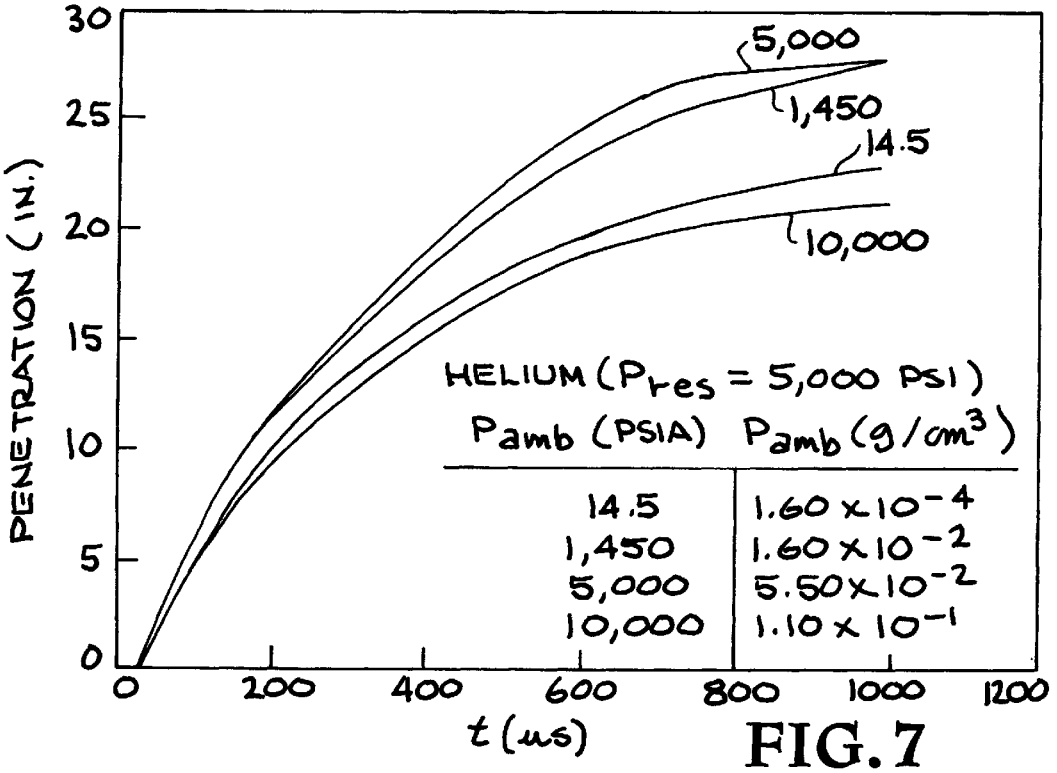
FIG. 7 shows calculated penetration in a concrete target as a function of helium pressure surrounding a shaped charge liner sealed within a container.

FIG. 7 summarizes the results of varying helium $P_1$ from 14.5 to about 10,000 psia. In this case, increasing the helium ambient pressure, $P_1$, from 14.5 to 1450 psia substantially increases the penetration. For instance, results at t=800 microseconds indicate a penetration of about 26 in. at 1450 psia in the helium system of FIG. 7 compared to a penetration of about 19 in. at the respective conditions in the pressurized air system of FIG. 5, i.e., a increase by a factor of more than 1.3. Increasing $P_1$ by another factor of at least 3, to, for example 5,000 psia, further increases the penetration. At still higher pressure, the penetration begins to decrease; when the initial surrounding helium pressure is 10,000 psia, the penetration is still slightly higher than that achieved with air at the increased pressure of 1,450 psia; the gas density is about the same in the latter two cases.

Figure 8:
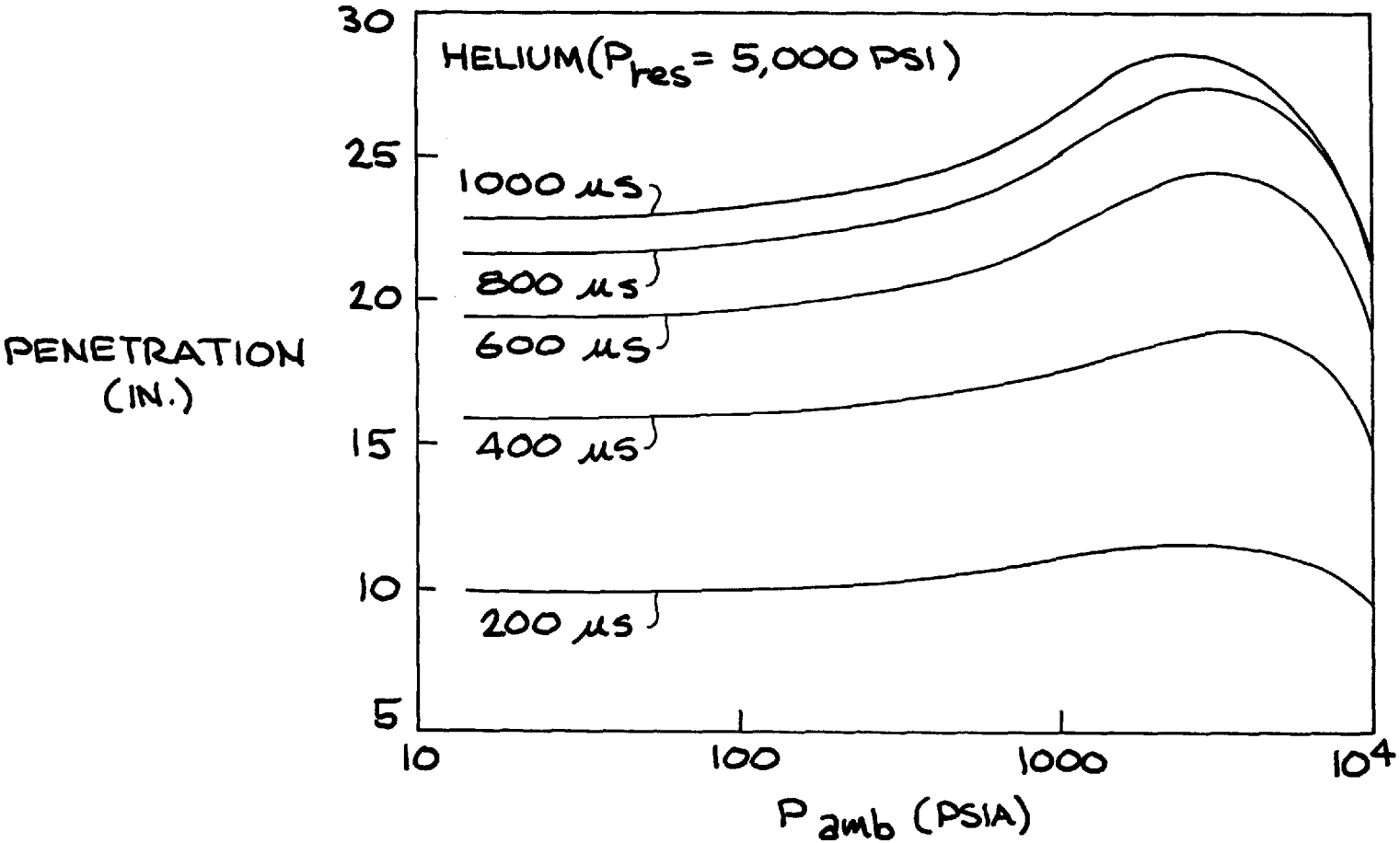
FIG. 8 illustrates a crossplot of the penetration data of FIG. 7 showing maximum penetration in the range from about 1,500 psia to about 5,000 psia surrounding the shaped charge.
Figure 9B:
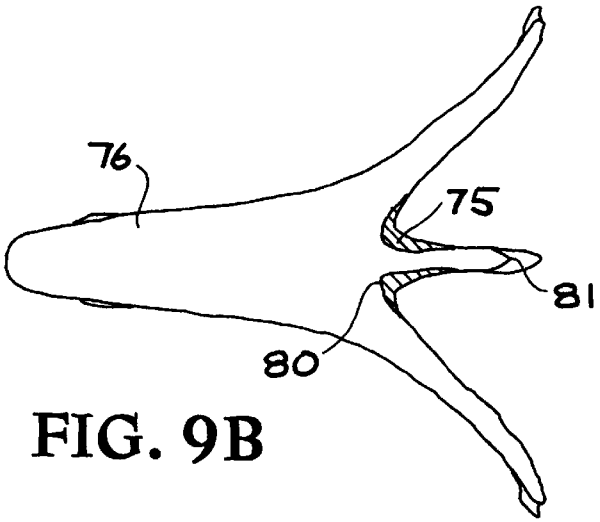
FIGS. 9*a*, 9*b*, 9*c*, and 9*d* illustrate four increasingly narrow and elongated shaped charged jets when four respective increasing helium pressures (14.5, 1,450, 5,000, 10,000 psia) are exerted on a liner 10 microseconds after initiation of explosion.
Figure 9D:
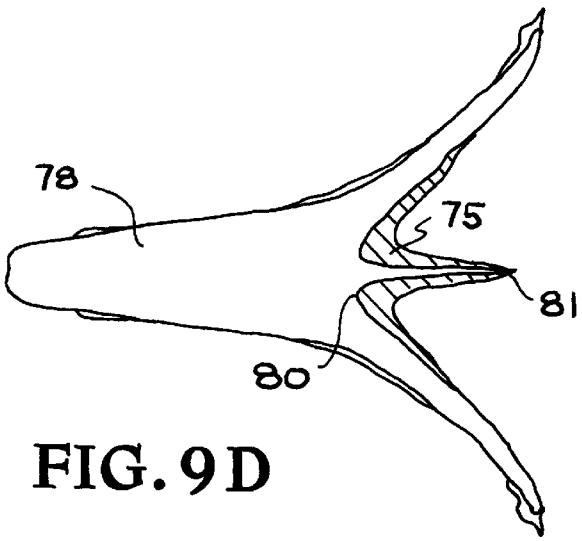
Figure 9A:
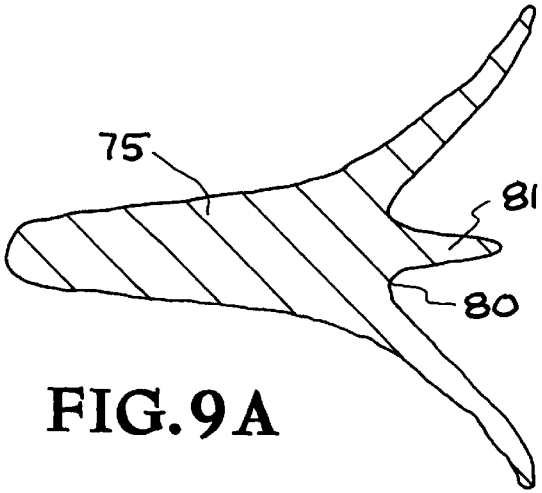
Figure 9C:
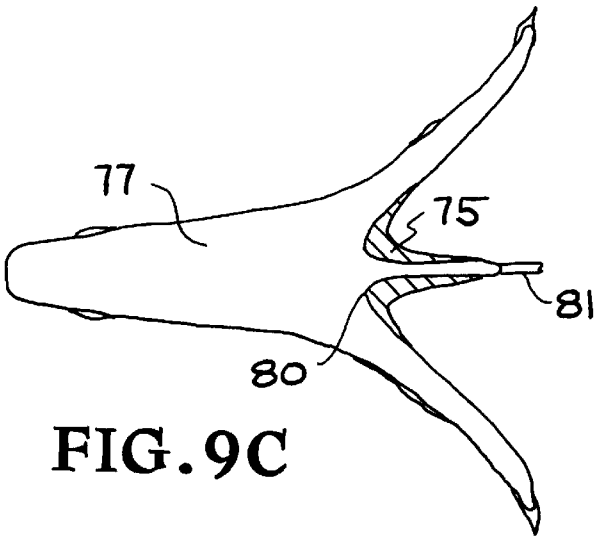
Figure 10A:
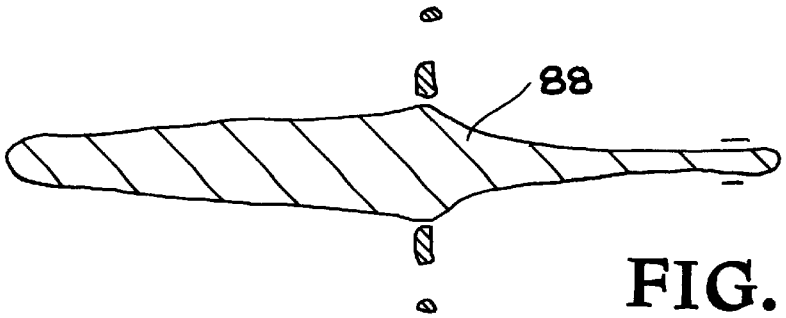
FIGS. 10*a*, 10*b*, 10*c*, and 10*d* illustrate four increasingly stretched shaped charged jets when four respective increasing helium pressures (14.5, 1,450, 5,000, 10,000 psia) are exerted on a liner 20 microseconds after initiation of explosion.
Figure 10B:
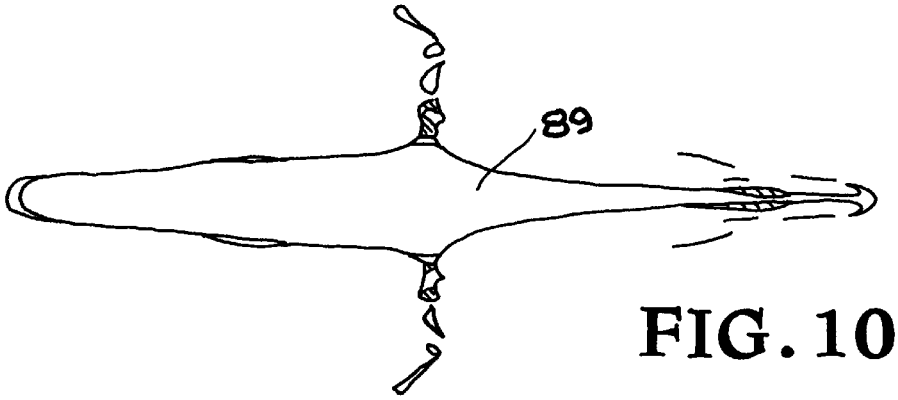
Figure 10C:
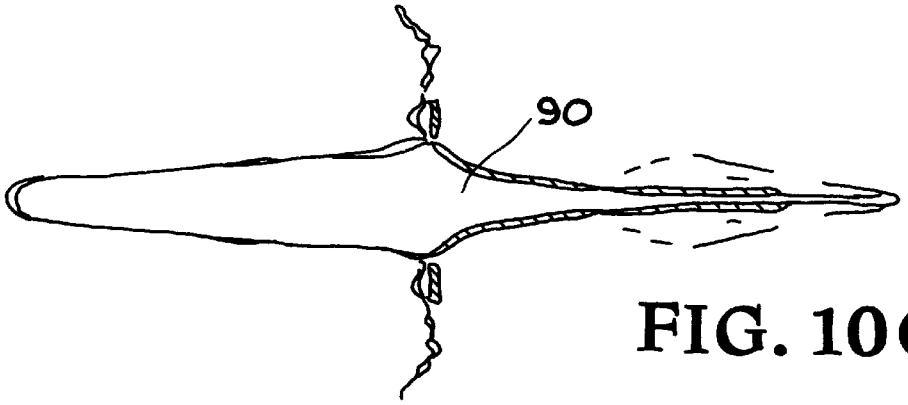
Figure 10D:
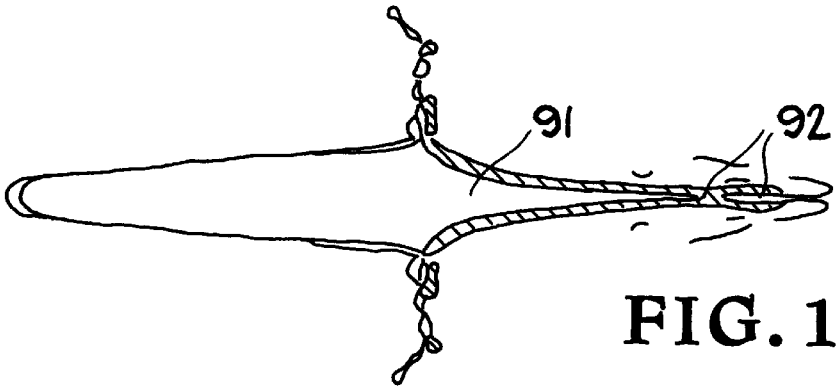

For the present design, the maximum penetration, with helium, occurs when $P_1$ is between about 1,500 and about 5,000 psia. FIG. 8 crossplots the data in FIG. 7. It is observed that, although final penetration has not stabilized in all the calculations, the penetration of the shaped charge surrounded with helium at 1,500 psia is at least 25% greater than the penetration obtained when the shaped charge liner is surrounded by air at normal pressure.

FIGS. 9*a*–9*d* and 10*a*–10*d* illustrate the physical basis for this increased performance. In both figures, cross sections are overlaid of only the liner material for each of the calculations described in FIGS. 7 and 8. In FIG. 9*a*–9*d*, the overlays are displayed at 10 microseconds, when the jet tip velocity has attained its maximum value, prior to perforation of the first plate (gun wall). The base profile 75 is the liner cross section in the 14.5 psia calculation, i.e., FIG. 9*a*, having a jet tip base 80 and a jet tip 81; the jet overlays 76, 77, and 78 of FIGS. 9*b*–9*d*, respectively, are the result of the other calculations. It is clearly observed that, as the initial helium pressure surrounding the liner is increased from 1,450 psia to 5,000 psia, to 10,000 psia, in FIGS. 9*b*–9*d*, respectively, the base 80 of the jets is forced to recede and an increasingly narrow and elongated jet, including jet tip 81, is produced.

FIGS. 10*a*, 10*b*, 10*c* and 10*d* depict the liner profiles at 20 microseconds. As the initial surrounding pressure increases from the base profile of jet 88 of FIG. 10*a*, the jets 89, 90 and 91 of FIGS. 10*b*–10*d*, respectively, are seen to elongate and their cross sections diminish. When $P_1$ is 10,000 psia in FIG. 10*d*, the jet tip 92 is still slightly ahead of the low-pressure case, but the calculation shows evidence of jet breakup beginning to occur. The interface treatment implicitly produces the breakup effect when the cross section gets sufficiently small; gas and jet material are then intermixed, and the local density is concomitantly reduced which, in turn, tends to decrease penetration.

Accordingly, analysis of a shaped charge perforator (jet) has shown that the penetration can be substantially enhanced by imploding the liner in a high pressure, light gas atmosphere. With the light gas helium pressurized at about 1,500 to about 5,000 psia, the penetration into confined concrete cylinders is increased by at least 40% in comparison to that achieved when the liner of a shaped charge is surrounded by and operated in air at standard temperature and pressure. The increased performance results from the gas pressure acting to confine the jet on the axis of penetration in the latter stages of formation. Since high density is concomitant with high pressure, a light gas, such as helium or hydrogen, allows the gas density to be kept low enough to not inhibit liner collapse.

Commercial perforators used in oil or gas well stimulation are normally disadvantaged by the short standoff forced upon them by their insertion in casing guns; inadequate space is available for the jets to stretch to optimum length for use in casing guns. Thus, high gas pressure can compensate for the lack of space by squeezing on the periphery of the jet, thereby producing added elongation. In the downhole location, the high pressure and lighter gas surrounding the shaped charge perforator has the added advantage that the wall thickness of the casing gun can be diminished, since the pressure differential between the internal gun and wellbore is thereby decreased. Such a small or essentially nonexistent pressure differential has the potential for producing a lighter, and hence less costly, gun assembly. Balanced against these potential advantages is the added complexity in positioning a high pressure system in the downhole location.

The inventive system can utilize a pressure regulator that senses the exterior wellbore pressure and automatically adjusts the interior gun pressure to minimize the pressure differential.

The invention is further illustrated by the following example which is illustrative of specific modes of practicing the invention and is not intended to be exhaustive or to limit the invention to the precise forms described.

EXAMPLE

Shaped charges are fired at two (2) API Section 1 targets, each using 4⅝" (OMNI) guns (12 SPF). Both concrete targets have been poured on the same day and cured for the same period. In one target the gun is operated with interior ambient air pressure and in the other a sealed 2,000 psi (138 bar) helium pressurization system is employed.

Using the 4⅝" OMNI gun apparatus having means for maintaining the pressurized helium downhole, the average penetration from 37 perforations is increased 40.3% over that obtained with the conventional perforating apparatus and system (the standard deviation being 11.3% of the mean for the pressurized helium system and 12.9% for the conventional system).

It should be noted that such results exceed the predicted performance. (The predicted simulations are made for an ideal (axisymmetric) perforator.) The presence of the high-pressure light gas surrounding the jet inhibits instabilities that enable the jet to wander off axis and markedly decrease penetration. The resulting perforations in the gun surrounded by helium are visually much straighter and cleaner and the gun-holes appear much more uniformly round. Such penetration results also suggest enhanced hydraulic fracturing can be accomplished with the pressurized light gas (helium) system.

Although particular embodiments of the present invention have been described and illustrated, such is not intended to limit the invention. Modifications and changes will no doubt become apparent to those skilled in the art, and it is intended that the invention only be limited by the scope of the appended claims.

The invention claimed is:

1. A method for enhancing the penetration of a shaped charge perforator, said method comprising:

imploding a liner of said shaped charge perforator in a high pressure, light gas atmosphere.

2. The method of claim 1 wherein said light gas atmosphere comprises a gas or a mixture of gases having a density less than air at the same conditions.

3. The method of claim 2 wherein said light gas comprises helium or hydrogen.

4. The method of claim 1 wherein said light gas comprises helium.

5. The method of claim 1 wherein said high pressure is about 500 psia to about 10,000 psia.

6. The method of claim 5 wherein said high pressure is about 1,000 psia to about 6,000 psia.

7. The method of claim 1 wherein said high pressure, light gas atmosphere and said liner is located within a sealed casing gun.

* * * * *